US008475652B2

(12) United States Patent
Paul et al.

(10) Patent No.: US 8,475,652 B2
(45) Date of Patent: Jul. 2, 2013

(54) METHOD FOR PURIFICATION OF UNCATALYZED NATURAL FUELS FROM METAL IONS BY MEANS OF AT LEAST ONE HEMEPROTEIN AND USE OF THE AT LEAST ON HEMEPROTEIN

(76) Inventors: Jan A. K. Paul, Luleå (SE); Michael L. Smith, Phoenix, AZ (US)

( * ) Notice: Subject to any disclaimer, the term of this patent is extended or adjusted under 35 U.S.C. 154(b) by 719 days.

(21) Appl. No.: 12/581,608

(22) Filed: Oct. 19, 2009

(65) Prior Publication Data

US 2011/0089083 A1 Apr. 21, 2011

(51) Int. Cl.

| | |
|---|---|
| ***C10G 31/00*** | (2006.01) |
| ***C10G 29/20*** | (2006.01) |
| ***C10G 29/00*** | (2006.01) |

(52) U.S. Cl.

USPC ..... 208/251 R; 208/39; 208/40; 208/177; 208/309

(58) Field of Classification Search

USPC ..... 208/251, 251 R, 39, 40, 177, 309

See application file for complete search history.

(56) References Cited

U.S. PATENT DOCUMENTS

| | | | | |
|---|---|---|---|---|
| 4,045,384 | A | 8/1977 | Dorman | |
| 4,140,662 | A | 2/1979 | Reckel | |
| 4,419,444 | A | 12/1983 | Quash | |
| 4,421,896 | A | 12/1983 | Dorman | |
| 4,454,240 | A * | 6/1984 | Ganguli | 502/26 |
| 4,563,431 | A | 1/1986 | Pauly | |
| 4,672,040 | A * | 6/1987 | Josephson | 436/526 |
| 2005/0238617 | A1 | 10/2005 | Li | |
| 2006/0155059 | A1 | 7/2006 | Harris | |

FOREIGN PATENT DOCUMENTS

| | | |
|---|---|---|
| EP | 0510356 | 10/1992 |

OTHER PUBLICATIONS

Toshio Asakura, Studies on Cytochrome c Peroxidase, 1969, The Journal of Biological Chemistry, vol. 244, No. 3, pp. 537-544.*

Anwar, et al, Determination of Trace Metals in Crude Oil Samples by Atomic Absorption Spectroscopy Using a Mixed Solvent System, 1990, Journal of the Chemical Society of Pakistan, vol. 12, No. 3, pp. 249-252.*

Yonetani, T, Studies on Cytochrome c Peroxidase, The Journal of Biological Chemistry, vol. 242, No. 21, 1967, pp. 5008-50013.*

Garcia-Arellano, H; Buenrostro-Gonzalez, E; et al.,"Biocatalytic transformation of petroporphyrins by chemical modified cytochrome c". . . Biotechnology and Bioengineering, 2004, vol. 85(7) pp. 790-798, John Wiley & Sons, Inc., N. Y. www3.interscience.wiley.com/journal/117933915/grouphome/home.html.

Mogollon,L.; Rodriquez,R."Biocatalytic removal of nickel and vanadium from petroporphyrins and asphaltenes". . . Applied Biochemistry and Biotechnology,1998, vol. 70-72 pp. 765-777. Publisher: Springer, www.springerlink.com/content/120548/.

D'Antonion, J.; Ghiladi, R.A., "Degradation of Petroporphyrin Mimics by Heme Oxygenase." Abstracts, 60th Southeast Regional Meeting of the . . . American Chemical Society, Nashville, TN, United States, Nov. 12-15 (2008), SERM-511. Publisher: American Chemical Society, Washington, D.C.

Fedorak, P.M.; Semple,K.M.; et al.,"Chloroperoxidase-mediated modifications of petroporphyrins and asphaltenes". . . Enzyme and Microbial Technology,1993,vol. 15(5) pp. 429-437,Elsevier B.V. www.elsevier.com/wps/find/journaldescription.cws_home/525004/description#description.

Inada,Y;Takahashi,K;et.al;"Application of polyethylene glycol-modified enzymes in biotechnological processes: organic solvent-soluble enzymes". . . Trends in Biotechnology, 1986, Jul., vol. 4(7), pp. 190-194, Elsevier B.V., www.cell.com/trends/biotechnology/home.

Bangs,L;"Adsorption to Microspheres" TechNote #204, Rev. #002, Active: Apr. 29, 2008, Bangs Laboratories, Inc., Fishers, IN 46038-2886 www.bangslabs.com/literature/technote.

Bangs,L;"Covalent Coupling" TechNote #205, Rev. #004, Active: Apr. 10, 2008, Bangs Laboratories, Inc., Fishers, IN 46038-2886 www.bangslabs.com/literature/technotes.

Inada,Y; Takahashi,K;et.al.;"Application of PEG-enzyme and magnetite-PEG-enzyme conjugates for biotechnological processes". . . Trends in Biotechnology, Jul. 1988, vol. 6(6), pp. 131-134, Elsevier B.V.,www.cell.com/trends/biotechnology/home.

Scott,CD; Scott,TC; Woodward,CA;"The chemical modification of enzymes to enhance solubilization in organic solvents for interaction with coal" 1993, Fuel, vol. 72 (12) pp. 1695-1700. Elsevier www.elsevier.com/wps/find/journaldescription.cws_home/30420/description#description.

Scott,EE; Paster,EV; Olson,JS; "The Stabilities of Mammalian Apomyoglobins Vary over a 600-Fold Range and Can Be Enhanced by Comparative Mutagenesis" 2000, Journal of Biological Chemistry, vol. 275 (35), pp. 27129-27136. American Society for Biochemistry and Molecular Biology www.jbc.org/.

Ali,MF; Abbas,S; "A review of methods for the demetallization of residual fuel oils" 2006, Fuel Processing Technology 87 pp. 573-584. Elsevier www.elsevier.com/wps/find/journaldescription.cws_home/502685/description.

(Continued)

*Primary Examiner* — Walter D Griffin
*Assistant Examiner* — Derek Mueller
(74) *Attorney, Agent, or Firm* — Dickstein Shapiro LLP

(57) ABSTRACT

A method for purification of uncatalyzed natural fuels in liquid state from metal ions by removing at least one compound selected from the group consisting of natural occurring contaminating porphyrins, metalloporphyrins, chlorins and naturally occurring degradations products of these compounds, such as petroporphyrins, containing said metal ions from the fuels. At least one hemeprotein in apo-form selected from the group consisting of globins, peroxidases, pyrrolases and cytochromes having high affinity for porphyrins is added to the fuels. The hemeprotein is mixed with the fuels in such a way that the porphyrins is bounded to the hemeprotein. The hemeprotein with bound contaminating porphyrins is removed so as to obtain purified fuels. The invention relates also to the use of at least one hemeprotein selected from the group consisting of globins, peroxidases, pyrrolases and cytochromes having high affinity for porphyrins for the purification of uncatalyzed natural fuels in liquid state from metal ions.

20 Claims, No Drawings

OTHER PUBLICATIONS

Takahashi, K.; Nishimura, H., et.al., "A chemical modification to make horseradish peroxidase soluble and active in benzene";..Biochemical Biophysical Research Communications,1984, vol. 121(1), pp. 261-265, Academic Press, Inc.; Online: Elsevier B.V. www.elsevier.com/wps/find/journaldescription.cws_home/622790/description#description.

Kodera, Y; Matsushima, A, et.al; "PEGylation of proteins and bioactive substances for medical and technical applications", Progress in Polymer Science, 1998 vol. 23, pp. 1233-1271, Elsevier, Science Ltd. www.elsevier.com/wps/find/journaldescription.cws_home/418/description#description.

* cited by examiner

METHOD FOR PURIFICATION OF UNCATALYZED NATURAL FUELS FROM METAL IONS BY MEANS OF AT LEAST ONE HEMEPROTEIN AND USE OF THE AT LEAST ON HEMEPROTEIN

FIELD OF THE INVENTION

The present invention relates to a method for purification of uncatalyzed natural fuels in liquid state from metal ions by removing naturally occurring contaminating porphyrins, metalloporphyrins, chlorins, and naturally occurring degradations products of these compounds containing said metals from said fuels.

The present invention relates also to the use of at least one hemeprotein in apo-form having high affinity for at least one compound selected from the group consisting of porphyrins, metalloporphyrins, chlorins, and natural degradation products of these compounds for purification of uncatalyzed natural fuels in liquid state from metal ions.

BACKGROUND OF THE INVENTION

A major problem and expense during the refining of oil and other petroleum products is the continuous contamination of solid, porous catalysts by various porphyrins, metalloporphyrins, chlorins, and natural degradation products of these compounds, such as petroporphyrins, containing metals such as vanadium and nickel. Catalyst contamination is a major problem during refining and leads to loss of catalytic efficiency, which in turn demands the catalytic process be interrupted to either replace or clean the catalyst at a huge cost. The direct, material cost of replacing contaminated catalysts for the United States petroleum industry is estimated at more than $1 billion, annually.

Porphyrins, metalloporphyrins, chlorins, and the natural degradation products of these compounds, such as petroporphyrins, are referred to as simply porphyrins or metalloporphyrins from here forward. The term uncatalyzed is used to mean the state of liquid fuel before being subjected to cracking catalysis, a common step during the petroleum refining process here forward. Thus, uncatalyzed fuels mean uncracked fuels in the usual sense.

Contamination of petroleum catalysts occurs simultaneously via porphyrins and coke deposition on the catalyst surface. The coke contaminant is primarily carbon and may be removed from the catalyst by several simple means with regeneration of much lost catalytic activity. The porphyrins deposits, however, consists of several different metals on the catalytic surface including vanadium (V), nickel (Ni), titanium (Ti), iron (Fe), copper (Cu) or a combination thereof with the concentrations of V and Ni varying from a few to several hundred parts per million (ppm), depending on the type of crude oil supply. The functional lifetime of the catalyst is inversely proportional to the amount of contaminating metal deposited on that catalyst, so the gradual deposition of these metals on to the catalytic surface leads to eventual loss of catalytic power. Vanadium is usually present in a concentration greater than other metals with much more than half of all V being deposited on the catalyst arising from the porphyry complex. So removal of just the vanadium porphyrins from the crude oils would be commercially important.

Metal deposition is thought to proceed when contaminating metalloporphyrins bind near or at the catalytic site, becoming degraded after a short time, leaving the contaminating metal at the catalytic site which irreversibly deactivates the catalyst. It has been shown by observations using electronic spectroscopy that oxovanadium porphyrins bind to specific sites on two types of catalysts. Others have reported similar results of specific physical interactions between vanadium porphyrins and catalysts. The resulting metal complexes from petroleum contaminants with catalysts, primarily V and Ni, cannot be economically removed and eventually destroy the catalytic capability of the catalyst over time. In the end, the spent catalyst must be discarded and is currently deemed hazardous waste.

Reclamation of the spent catalyst, if performed at all, is both expensive and time consuming. Some microorganisms have been shown capable of removing some of the contaminating porphyrins and/or metals but these methods take several days to weeks to apply. These types of reclamations demand first rinsing the petroleum from the catalyst before application and then re-introduction of the petroleum via solvent exchange, taking time and labor. A variation of the method using the microorganism *Aspergillus* requires an expensive buffer salt for proper results. Chemical methods are also time consuming and take several steps, but only partly rejuvenate the catalytic function.

SUMMARY OF THE INVENTION

A first object of the invention is to provide a method for purification of uncatalyzed natural fuels in liquid state from metal ions by removing at least one compound selected from the group consisting of natural occurring contaminating porphyrins, metalloporphyrins, chlorins, and naturally occurring degradations products of these compounds, containing the metal ions, from the fuels.

A second object of the invention relates to the use of at least one hemeprotein in apo-form having high affinity for at least one compound selected from the group consisting of natural occurring contaminating porphyrins, metalloporphyrins, chlorins, and naturally occurring degradations products of these compounds for purification of uncatalyzed natural fuels in liquid state from metal ions.

The first object of the invention is achieved by the method comprising the steps of:

a) adding at least one hemeprotein in apo-form having high affinity for the compound to the fuels,
b) mixing the hemeprotein with the fuels in such a way that the compound is bounded to the at least one hemeprotein, and
c) removing the at least one hemeprotein with bound contaminant compound so as to obtain purified fuels.

The second object of the invention is achieved by adding the hemeprotein having a high affinity for the compound to the fuels, mixing the hemeprotein with the fuels in such a way that the compound is bound to the hemeprotein, and removing the hemeprotein with bound contaminant compound so as to obtain purified fuels.

DETAILED DESCRIPTION OF THE INVENTION

In the specification below, examples of natural fuels are, but are not limited to, oils, crude oils, refined oils, gasolines or kerosenes and a blend of these either partially purified or crudely refined, liquefied or solubilized coals or coal gases, petroleum liquids, liquefied or solubilized shale oils or shale oil gases, liquefied asphaltites, and agricultural oils.

There are several different types of porphyrins, chlorins and breakdown products present in natural fuels. Some of these have been identified and all are structurally related to the common naturally occurring porphyrin IX, which is closely related to the hemin portion of the proteins hemoglobin, myoglobin (Mb), peroxidases, cytochromes and to several plant chlorophylls. Some coals have been found to contain high amounts of iron porphyrin derivatives (hemes or hemins); iron etioporphyrin III and closely related porphyrins. The nickel, vanadyl, copper and free base etioporphyrin III complexes, related to hemes and chlorophylls, have been found in shale oils and thought to have been derived from porphyrin IX precursor. Nickel porphyrins have been independently found in high quantities in other shale oils. Iron porphyrin derivatives in coals have been reported in deposits world-wide.

One protein which has a high affinity for porphyrins is apomyoglobin (apoMb) and another is horseradish peroxidase A2 (apoA2). It is well known that proteins such as myoglobin, hemoglobin and peroxidase can be separated into the hemin fraction and the protein polypeptide fraction (apoprotein) by treatment with acidified acetone, or with acidified 2-butanone. While apohemoglobin is not very stable in any solvent, apomyoglobin and apoperoxidase are stable in aqueous solution even in the absence of heme and very rapidly recombines with free heme. Apomyoglobin also has a very high affinity for several different types of hemins and porphyrins and it will even remove these from other hemoproteins. Although chlorophylls are biosynthesized by many plants and algae but not by animals, mammalian apomyoglobin will even bind chlorophylls. Apomyoglobin has also been shown to readily bind the breakdown products of hemin, biliverdin, which is no longer even considered a porphyrin.

Most proteins are not very stable even in buffered water, with the difference in energy between the active and denatured states being small. Compared to most proteins myoglobin is quite stable with the energy of stabilization being quite high. The stability of the complete myoglobin molecule and the apomyolobin portion both depend upon the species of origin, with the myoglobin from sperm whale being quite stable and the myoglobin from horse being considerably less stable. Protein stability depends on the specific arrangement of the amino acids making up the polypeptide chain.

The stability of many proteins and enzymes has been shown to be considerably enhanced by chemically treating the amino acid side-chains with reagents, especially those based around polyethylene glycol (PEG). Protein modification with PEG sometimes leads to loss of enzyme activity but just as likely to enhanced activity. Modified enzymes have been used in organic solvents to convert coal into liquid petroleum products. Certain modified enzymes display enhanced solubility, enhanced catalytic capability and thermal stability in organic solvents, whether modified by PEG or with dinitrofluoroenzene (DNFB). Several other protein modifying agents have been used for practical purposes though PEG seems the agent of common choice. While apomyoglobin and apoperoxidase are stable in buffered water and certain organic solvents such as acetone and 2-butanone, these denature in organic solvents like hexane, isooctane and kerosene. Some hemeproteins such as horseradish peroxidase, catalase and chloroperoxidase have been stabilized in organic solvents by chemical modification with PEG and retain high specific activity and enhanced thermal stability. Studies indicate that some proteins may be bound to solid support such as surface modified silicates and polystyrenes/latex beads. Protein stability is enhanced when proteins or even unstable protein fragments are bound to solid surfaces.

Thus, preferably, the hemeprotein is selected from the group consisting of:

a) globins, such as hemoglobins, myoglobins and plant hemoglobins,
b) peroxidases and pyrrolases, such as animal, plant peroxidases, and peroxidases from single cell organisms, and animal, plant pyrrolases, and pyrrolases from single cell organisms.
c) cytochromes, such as animal, plant cytochromes, animal cytochromes and cytochromes from single cell organisms, and
d) genetically modified hemeproteins where the genetic codes from a single organism or a combination of genetic codes from several different organisms are fused to make a novel amino acid sequence that binds hemes and chlorins,
e) and a combination thereof.

EXAMPLES

Example 1

Horse myoglobin (horse Mb), which is not considered a very stable myoglobin (Mb), 20 mg, was treated with polyethylene glycol dimesylate (PEG), 20 mg, in 10 ml of aqueous 100 mM borate buffer, pH 8.45 for 28 hours. The heme was removed from the PEG-modified-Mb by treating with 14 volumes of cold (−10° C.) acetone acidified with 0.2% HCl for ½ hour. The modified protein (apo-PEG-Mb) was collected by centrifugation then dissolved in 5 ml of 10 mM borate, pH 8.25. Examination by ultraviolet-visible (UV-vis) spectroscopy showed that >95% of the heme had been removed from the protein.

Apo-PEG-Mb, 1.5 ml of 140 μM, solution was gently shaken at 185 rpm with 0.6 ml of hemin chloride, 100 μM, in kerosene-ethanol-pyridine (45:4:1, v:v:v) for 1 hour. The aqueous and kerosene phases were separated by centrifugation and the transfer of heme to the apo-PEG-Mb was checked with UV-vis spectroscopy. More than 95% of the hemin chloride originally in the kerosene phase had been transferred to the apo-PEG-Mb in the aqueous phase. The aqueous phase, now containing the hemin-PEG-Mb complex, was clear without any evidence of protein denaturation.

Example 2

Two 10% suspensions of polystyrene (latex) particles, 0.33 μm diameter containing amino groups on the particle surface, were added to 10 mg of horse Mb in 5 mL borate buffered water, pH 8.4 to a final concentration of 1% latex, each. One 5 mL suspension contained 0.2% glutaraldehyde and the second 5 mL suspension contained 0.5% glutaraldehyde. Both suspensions were gently agitated at 195 rpm for 30 minutes then 10 mg of solid $NaCNBH_4$ was added to both suspensions and agitation continued for 5 minutes. Polyethylene glycol dimesylate (18 mg) was added to both suspensions and agitation continued for 45 minutes. After centrifugation, the solution was decanted and both particle suspensions, now displaying brown coloration as evidence of Mb bound to the surface, were washed once with 10 ml of phosphate buffer, 10 mM, pH 7.4. After another centrifugation both preparations (PEG-Mb-latex) were stored under the same phosphate buffer.

The heme was removed from the two PEG-Mb-latex suspensions in a similar manner to Example 1, except at +1° C., washed with phosphate buffer, pH 7.4 and stored in this same buffer. The particles (PEG-apoMb-latex) were now a very light tan color, evidence of heme removal from the particle bound myoglobin. The particles were dried with acetone before further use.

Two solutions of protoporphyrin IX dimethyl ester (PPIXDME), which is a porphyrin derivative with a low affinity for apomyoglobin, were made by first dissolving a few crystals in a small drop of pyridine then diluting with 10 ml of kerosene. The acetone dried, PEG-apoMb-latex solids were added to the kerosene solutions of PPIXDME, and the mixture shaken at 185 rpm for 2 hours. The PEG-apoMb-latex/protoporphyrin IX DME complexes, now a dark reddish-brown color, were separated from the kerosene solutions by low-speed centrifugation. Examination of the UV-visible spectrum of the supernatant kerosene solutions revealed that about 20 to 25% of the PPIXDME had been removed from solutions by the PEG-apoMb-latex.

Example 3

A 20 mg solution of peroxidase A2 (from horseradish root) in 50 mM acetate buffer, pH 5.5 was treated with 15 mM sodium periodate at room temperature and after 30 minutes glycerol was added to a concentration of 100 mM. After another ½ hour the protein was dialyzed against 100 volumes of borate buffered water, 10 mM, pH 8.4 for several hours.

A 10% suspension of polystyrene (latex) particles in water, 0.33 μm diameter containing amino groups on the particle surface, was added to 10 mg of treated peroxidase A2 in 5 ml borate buffered water, pH 8.4 to a final concentration of 1% latex. The suspension was gently agitated at 195 rpm for 30 minutes then a few grains of solid sodium borohydride were added and agitation continued for 30 minutes. Dibromo polyethylene glycol (20 mg) was added to the suspension and agitation continued for another 45 minutes. After centrifugation, the reaction solution was decanted and the particle suspensions, now displaying brown coloration as evidence of peroxidase A2 bound to the surface (PEG-A2-latex) was washed once with 10 ml of phosphate buffer, 10 mM, pH 7.4. After another centrifugation the PEG-A2-latex was stored under the same phosphate buffer.

The heme was removed from the PEG-A2-latex suspensions in a similar manner to Example 1, except at +1° C., washed with phosphate buffer, pH 7.4 and stored in this same buffer. The particles (PEG-apoA2-latex) were now a very light tan color, evidence of heme removal from the particle bound peroxidase. The particles were dried with acetone before further use.

A solution of protoporphyrin IX dimethyl ester (PPIXDME), which is a porphyrin derivative with a low affinity for apoperoxidase A2, was made in a similar manner to example 2. The acetone dried, PEG-apoA2-latex suspension was added to the kerosene solutions of PPIXDME, and the mixtures shaken at 185 rpm for 2 hours. The PEG-apoA2-latex/protoporphyrin IX DME complex, now a dark reddish-brown color, was separated from the kerosene solution by low-speed centrifugation. Examination of the UV-visible spectrum of the supernatant kerosene solutions revealed that about 25 to 30% of the PPIXDME had been removed from the solutions by the PEG-apoA2-latex.

The inventors evaluated that it was necessary to depart from the usual purification scheme of oils, petroleum liquids, liquefied coal and liquefied shale oils to remove at least some of the commonly contaminating porphyrins which foul many downstream catalytic processes. Instead, the invention removes some contaminating porphyrins before these chemicals can be deposited on catalysts thus ruining the catalytic processes. Removal of these contaminants saves catalyst and reduces the time and labor necessary for replacement of the catalyst as well as increasing the total quantity and varieties of oils which can be refined. Horse myoglobin and plant peroxidase were chosen as the proteins used to synthesize the agents for removal of porphyrins from oils because these are known to be relatively stable towards injury compared to other globins, for instance compared with hemoglobin. Myoglobin and peroxidase, themselves are not capable of removing porphyrins from oils but must be considerably modified to allow function in this role. Mammalian myoglobins also differ in stability towards denaturation by injurious agents with the myoglobins from diving animals, such as whales, considered more stable than myoglobins from domesticated animals such as cows and horses. These different stabilities are due to differences in the amino acids making up the polypeptide of myoglobins and may be modified to become more or less stable by genetic means commonly employed by those proficient in that art.

For removal of porphyrins from oils, the natural prosthetic group of myoglobin and peroxidase, which is hemin or protohemin, is first required to be removed from the proteins. This is usually performed by subjecting the proteins to at least 10 volumes of either acetone or 2-butanone which has been acidified with a small quantity of acid, in this case hydrochloric acid (HCl) at reduced temperature. The acid used may include dilute HCl, HBr, $H_2SO_4$, trifloroacetic acid, difluoroacetic acid, chlorinated acids, $H_3PO_4$, and $H_3AsO_4$. The acid should be at least slightly soluble in the organic solvent used to remove heme. The apomyglobin and apoperoxidase thus synthesized exhibit reduced stability towards denaturing agents such as oils and petroleum products compared with the original proteins. In addition, myoglobin, apomyoglobin, peroxidase and apoperoxidase all exhibit poor solubility in organic solvents such as petroleum liquids. Because of these reasons apomyoglobin and apoperoxidase are not good reagents for removing porphyrins from petroleum liquids. The reverse reactions, which are the recombinations of apomyoglobin or apoperoxidase with many types of porphyrins and hemes, readily occur and are energetically highly favored in buffered aqueous solutions. The holoproteins thus synthesized exhibit stabilities similar to the original, native proteins. The holomyoglobin and holoperoxidase are examples of any heme-containing protein of good stability, initially derived from any species, including heme-containing proteins which are genetically modified from the original species to modify the apoprotein and holoprotein stabilities.

Apomyoglobin and peroxidase must be modified to be able to extract porphyrins from petroleum liquids and remain undenatured with continued ability to bind these chemicals. Modification of apomyoglobin and apoperoxidase allows better solubility of the apoproteins in petroleum liquids and enhances the ability of this apoprotein to remove porphyrins from these oils. Treatment of apomyoglobin and apoperoxidase with amino acid modifying reagents such as polyethylene glycol (PEG) derivatives with chemically active end-groups or short-chain alkanes with chemically active end-groups also greatly enhances the ability of the apoprotein to resist denaturation in petroleum liquids. Such reagents for protein modification are available and typically come in two varieties, those with a single chemically active end-group, with the other end of the PEG, alkane or aryl group being chemically inert, and another variety with both ends of the PEG or alkane being chemically active end-groups. Three chemically reactive protein modification reagents with two reactive end-groups used here are glutaraldehyde, a reactive alkane, and PEG (2,000) dimesylate and dibromo-PEG (2,000), where 2,000 refers to the approximate molecular weight of the PEG moiety. Any of these types of protein modification reagents may be used singly or in combination to synthesize chemically-modified apomyoglobin (chem-mod-apoMb) or apoperoxidase (chem-mod-apoA2). Other reagents which may be used are those which rely on carbodiimide coupling of carboxyl or tyrosyl groups on the hemeprotein or apohemeprotein to amino end-groups of PEG, alkanes or aryls. Other reagents which may be used are those which rely on coupling maleimide end-groups of PEG, alkanes or aryls with sulfhydryl containing amino acids on the hemeprotein or apohemeprotein.

After contaminant porphyrins are sequestered into the chemically modified apomyoglobin (the chem-mod-apoMb) or apoperoxidase (chem-mod-apoA2) to form a chem-mod-apoMb-contaminant complex (Mbcomplex) or to form chem-mod-apoA2-contaminant complex (A2complex); these must be removed from the petroleum liquids. A good means for accomplishing this is to couple the complex to a solid material, either a small particle which can be filtered or centrifuged away from the petroleum liquid or magnetically removed from the petroleum liquid or to a solid surface immersed in the petroleum liquid which can be removed or exchanged by mechanical means after the complex has been formed. The chem-mod-apoMb and chem-mod-apoA2 may be chemically coupled to a solid support prior to chemical modification of the reactive amino acids either as the native myoglobin or peroxidase or after the apoMb or apoA2 has been created by heme removal. Coupling of the myoglobin, apoMb, peroxidase or apoA2 to the solid support is more easily accomplished when the solid support carries a net positive electrical charge if the holoprotein or apoprotein is negatively charged in the coupling buffer, or to a negatively charged surface, or particle, for a holoprotein or apoprotein which carries a net positive electrical charge.

The solid support may be particles made of materials selected from the group consisting of polystyrenes, polyacrylamides, polyisocyanates, latexes, polybutenes, polyurethanes, particles synthesized from silica or other ceramics with surface modifications allowing chemical bonding of the holoproteins or apoproteins to the particle surface. The surface modifications of the particles may be any of the following though not limited to carboxyl, amino, aldehyde, alcohol, chloromethyl, bromomethyl, sugars or polysaccharides, guanidyl, sulfhydryl, selenyl, or phosphoryl groups whereby the coupling between the holoprotein or apoprotein and the solid support is selected from the group consisting of polyethylene glycols chemically activated at both or more ends by any of the following, bromo, chloro, iodo, amino, mesylate, tosylate, di-N-succinimidylester, maleimidyl, triazine or other chemically reactive groups which can react with amino, sulfhydryl, hydroxyl, histidyl tyrosyl or guanidyl groups found or embedded within holoprotein or apoprotein, glutaraldehyde, oxaldehyde, formaldehyde, succinyldialedehyde or alkane, aryl or hydrocarbon so modified to contain two or more chemically reactive groups which can react with the amino, sulfhydryl, hydroxyl, histidyl tyrosyl or guanidyl groups found or embedded within holoprotein or apoprotein, and amino- or carboxyl-containing solid to the carboxyl- or amino-groups of holoprotein or apoprotein using carbodiimide catalysis.

The Mbcomplex or A2complex containing the contaminating porphyrins, consisting of large concentrations of vanadium, nickel, or other metals, can be split into the porphyrin component and the apoprotein component by treatment with acidified acetone or 2-butanone or other similar acidified solvents. After removing the regenerated particles, the solvent may be easily removed by distillation and the residue, rich is vanadium, nickel and other metals, may be used as the starting material for purification of vanadium, nickel and other metals. It is not even necessary to ash this metalloporphyrin residue to reclaim the metals, since metal removal from porphyrins can be easily accomplished using alcohol-water mixtures acidified with common acids.

Although the above-mentioned experiments and specification describe reactions with and modification of globins and peroxidases, and more particular horse myoglobin and plant peroxidase A2, it is obvious for the person skilled in the art that the same reactions and modifications is easily made to plant hemoglobins (leghemoglobin) and cytochromes since they relate to the same type of proteins.

What is claimed is:

1. A method for purification of uncatalyzed natural fuels in liquid state from metal ions by removing at least one compound selected from the group consisting of natural occurring contaminating porphyrins, metalloporphyrins, chlorins and naturally occurring degradations products of these compounds, containing said metal ions from said fuels, comprising the steps of:

a) adding at least one hemeprotein in apo-form having high affinity for said at least one compound to said fuels, b) mixing said at least one hemeprotein with said fuels in such a way that said at least one compound is bound to said at least one hemeprotein, and c) removing said at least one hemeprotein with bound contaminating compound so as to obtain purified fuels.

2. The method according to claim 1, comprising the further steps of:

d) regenerating said at least one hemeprotein to free it from said contaminating compound, and e) recycling said at least one hemeprotein.

3. The method according to claim 1, wherein said at least one hemeprotein is selected from the group consisting of a) globins, such as hemoglobins, myoglobins and plant hemoglobins, b) peroxidases and pyrrolases, such as animal, plant peroxidases, and peroxidases from single cell organisms, and animal, plant pyrrolases, and pyrrolases from single cell organisms.

c) cytochromes, such as animal, plant cytochromes, animal cytochromes and cytochromes from single cell organisms, and d) genetically modified hemeproteins where the genetic codes from a single organism or a combination of genetic codes from several different organisms are fused to make a novel amino acid sequence that binds hemes and chlorins, e) and a combination thereof.

4. The method according to claim 1, wherein said uncatalyzed natural fuels is selected from the group consisting of oils, crude oils, refined oils, gasolines, kerosenes, a blend of these either partially purified or crudely refined, liquefied or solubilized coals, coal gases, petroleum liquids, liquefied, solubilized shale oils, shale oil gases, liquefied asphaltites, and agricultural oils.

5. The method according to claim 3, wherein said at least one hemeprotein is selected from the group consisting of apomyoglobin, holomyoglobin, apoperoxidase, holoperoxidase and a combination thereof, and wherein, in the case said hemeprotein is apomyoglobin or apoperoxidase, said apomyoglobin or the apoperoxidase is obtained by stripping native heme by using at least an acid selected from the group consisting of dilute HC1 and any of its derivatives, HBr and any of its derivatives, $H_2SO_4$ and any of its derivatives, trifloroacetic acid, HI and any of its derivatives, difluoroacetic acid, chlorinated acids, $H_3PO_4$, and $H_3AsO_4$.

6. The method according to claim 5, wherein the holomyoglobin is any heme-containing protein of good stability, initially derived from any species, including heme-containing proteins which are genetically modified from the original species to modify the apoprotein and holoprotein stabilities.

7. The method according to claim 5, wherein the surface of the apomyoglobin or the apoperoxidase is chemically modified in such a way that it imparts the ability of the apomyoglobin to become a solute in non-aqueous liquids of uncatalyzed natural fuels selected from the group consisting of oils, crude oils, refined oils, gasolines, kerosenes, a blend of these either partially purified or crudely refined, liquefied or solubilized coals, coal gases, petroleum liquids, liquefied, solubilized shale oils, shale oil gases, liquefied asphaltities, and agricultural oils.

8. The method according to claim 7, wherein the chemical modification of the apomyoglobin or the apoperoxidase is made by treatment of the apomyoglobin or the apoperoxidase with at least one reagent selected from the group consisting of amino acid modifying reagents such as polyethylene glycol (PEG) derivatives with at least one chemically active end-group, and short-chain alkanes with at least one chemically active end-group.

9. The method according to claim 8, wherein said at least one reagent is selected from the group consisting of those with a single chemically active end-group, with the other end of the PEG, alkane or aryl group being chemically inert, or with both ends of the PEG or alkane being chemically active end-groups.

10. The method according to claim 8, wherein said at least one regent is selected from the group consisting of carbodiimide coupling of amino groups on the apomyoglobin or the apoperoxidase to carboxyl end-groups of PEG, alkane or aryl groups, carbodiimide coupling of carboxyl or tyrosyl groups on the apomyoglobin to amino end-groups of PEG, alkanes or aryls, and coupling of maleimide end-groups of PEG, alkanes or aryls with sulfhydryl containing amino acids on apomyoglobin or the apoperoxidase.

11. The method according to claim 1, further comprising the step of, in combination with step b):

b1) binding said at least one hemeprotein to a solid support in the form of particles made of at least one material selected from the group consisting of polystyrenes, polyacrylamides, polyisocyanates, latexes, polybutenes, polyurethanes, particles synthesized from silica or other ceramics, said solid support having surface modifications allowing chemical bonding of said at least one hemeprotein to the particle surface, these surface modifications may be any of the following carboxyl, amino, aldehyde, alcohol, sugars or polysaccharides, guanidyl, sulfhydryl, selenyl, phosphoryl groups, magnetic polystyrene and latex, whereby the coupling between said at least one hemeprotein and the solid support is selected from the group consisting of polyethylene glycols chemically activated at both or more ends by any of the following, bromo, chloro, iodo, mesylate, tosylate, di-N-succinimidylester, maleimidyl, triazine or other chemically reactive groups which can react with amino, sulfhydryl, hydroxyl, histidyl tyrosyl or guanidyl groups found or embedded within at least one hemeprotein, glutaraldehyde, oxaldehyde, formaldehyde, succinyldialedehyde or alkane, aryl or hydrocarbon so modified to contain two or more chemically reactive groups which can react with the amino, sulfhydryl, hydroxyl, histidyl tyrosyl or guanidyl groups found or embedded within another at least one hemeprotein, and amino- or carboxyl- containing solid to the carboxyl- or amino-groups of said at least one hemeprotein using carbodiimide catalysis.

12. The method according to claim 11, wherein the particles are synthesized from any metal or from metals containing a magnetic ingredient comprising iron, cobalt, nickel or manganese or materials which may be magnetized before or after synthesis.

13. The method according to claim 1, wherein the metal ions are selected from the group consisting of ions of vanadium (V), nickel (Ni), titanium (Ti), copper (Cu), iron (Fe), and any combination thereof.

14. The method according to claim 11, wherein said at least one hemeprotein is apomyoglobin or apoperoxidase and wherein said at least one compound is sequestered into the chemically modified apomyoglobin or apoperoxidase to form an apomyoglobin or apoperoxidase contaminant complex, said complex being removed from the fuels by coupling the complex to the solid support, which can be filtered or centrifuged away from the fuels or magnetically removed from the fuels or to a solid surface immersed in the fuels which can be removed or exchanged by mechanical means after the complex has been formed.

15. The process of using of at least one hemeprotein in apo-form having high affinity for at least one compound selected from the group consisting of natural occurring contaminating porphyrins, metalloporphyrins, chlorins, and naturally occurring degradations products of these compounds for purification of uncatalyzed natural fuels in liquid state from metal ions, said purification comprising adding said at least one hemeprotein having high affinity for said at least one compound to said fuels, mixing said at least one hemeprotein with said fuels in such a way that said at least one compound is bound to said at least one hemeprotein, and removing said at least one hemeprotein with bound contaminating at least one compound so as to obtain purified fuels.

16. The process of using according to claim 15, wherein said uncatalyzed natural fuels is selected from the group consisting of oils, crude oils, refined oils, gasolines, kerosenes, a blend of these either partially purified or crudely refined, liquefied or solubilized coals, coal gases, petroleum liquids, liquefied, solubilized shale oils, shale oil gases, liquefied asphaltites, and agricultural oils.

17. The process of using according to claim 15, wherein said at least one hemeprotein is selected from the group consisting of apomyoglobin, holomyoglobin, apoperoxidase and apoperoxidase, and wherein in the case said hemeprotein is apomyoglobin or apoperoxidase, said apomyoglobin or said apoperoxidase is obtained by stripping native heme by using at least an acid selected from the group consisting of dilute HCI and any of its derivatives, HBr and any of its derivatives, $H_2SO_4$ and any of its derivatives, trifloroacetic acid, HI and any of its derivatives, difluoroacetic acid, chlorinated acids, $H_3PO_4$, and $H_3AsO_4$.

18. The process of using according to claim 15, wherein the holomyoglobin is any heme- containing protein of good stability, initially derived from any species, including heme-containing proteins which are genetically modified from the original species to modify the apoprotein and holoprotein stabilities.

19. The process of using according to claim 15, wherein the surface of the apomyoglobin or the apoperoxidase is chemically modified in such a way that it imparts the ability of the apomyoglobin or the apoperoxidase to become a solute in a non-aqueous liquids of uncatalyzed natural fuels selected from the group consisting of oils, crude oils, refined oils, gasolines, kerosenes, a blend of these either partially purified or crudely refined, liquefied or solubilized coals, coal gases, petroleum liquids, liquefied, solubilized shale oils, shale oil gases, liquefied asphaltites, and agricultural oils.

20. The process of using according to claim 15, wherein said at least one hemeprotein is bound to a solid support in the form of particles made of at least one material selected from the group consisting of polystyrenes, polyacrylamides, polyisocyanates, latexes, polybutenes, polyurethanes, particles synthesized from silica or other ceramics with surface modifications allowing chemical bonding of said at least one hemeprotein to the particle surface, these surface modifications may be any of the following carboxyl, amino, aldehyde, alcohol, sugars or polysaccharides, guanidyl, sulfhydryl, selenyl, phosphoryl groups, magnetic polystyrene and latex, whereby the coupling between said at least one hemeprotein and the solid support is selected from the group consisting of polyethylene glycols chemically activated at both or more ends by any of the following, bromo, chloro, iodo, mesylate, tosylate, di-N-succinimidylester, maleimidyl, triazine or other chemically reactive groups which can react with amino, sulfhydryl, hydroxyl, histidyl tyrosyl or guanidyl groups found or embedded within at least one hemeprotein, glutaraldehyde, oxaldehyde, formaldehyde, succinyldialedehyde or alkane, aryl or hydrocarbon so modified to contain two or more chemically reactive groups which can react with the amino, sulfhydryl, hydroxyl, histidyl tyrosyl or guanidyl groups found or embedded within said at least one hemeprotein, and amino- or carboxyl- containing solid to the carboxyl- or amino- groups of apomyoglobin using carbodiimide catalysis.

* * * * *